United States Patent [19]

Moore

[11] Patent Number: 4,803,860

[45] Date of Patent: Feb. 14, 1989

[54] MANIPULATION ASSISTANCE DEVICE AND METHOD

[76] Inventor: Randall L. Moore, 1696 Forest Hill Ct., Crofton, Md. 21114

[21] Appl. No.: 77,241

[22] Filed: Jul. 24, 1987

Related U.S. Application Data

[63] Continuation of Ser. No. 890,292, Jul. 29, 1986, abandoned.

[51] Int. Cl.[4] ..... E05B 17/00

[52] U.S. Cl. ..... 70/446; 70/442

[58] Field of Search ..... 70/446, 442, 448, 334; 73/593, 591, 570; 364/180, 174, 400, 188, 189; 361/171

[56] References Cited

U.S. PATENT DOCUMENTS

| | | | |
|---|---|---|---|
| 2,974,517 | 3/1961 | Jacobs | 70/442 |
| 3,694,637 | 9/1972 | Edwin | 73/593 |
| 4,056,956 | 11/1977 | Gilliam | 70/446 |
| 4,433,563 | 2/1984 | Wilson | 70/446 |

*Primary Examiner*—Robert L. Wolfe

*Attorney, Agent, or Firm*—Hall, Myers & Rose

[57] ABSTRACT

Apparatus for assisting in the determination of the combination of a safe lock by aiding a locksmith in the art of manipulation. This device replaces the locksmith's senses of sight, hearing and touch, used in manipulation of combination locks. Sight is replaced by an optical scanner and target. Hearing and touch are replaced by a microphone and amplifier with a peak detector. The device will provide a locksmith with accurate contact readings when practicing the art of manipulation.

21 Claims, 5 Drawing Sheets

MANIPULATION ASSISTANCE DEVICE AND METHOD

BACKGROUND OF THE INVENTION

This is a continuation of application Ser. No. 890,292, filed July 29, 1986 and now abandoned.

The present invention relates to combination lock manipulation techniques. More particularly, the present invention relates to an electronic device to aid an individual in the process of manipulation of a combination lock.

The ability to determine the proper combination of a lock through manipulation techniques is a useful skill in the locksmith profession. Through manipulation a skilled locksmith can open a combination lock without prior knowledge of the combination, without the use of force and without damaging the lock mechanism or the enclosure secured by the lock.

A detailed description of manipulation of combination locks is presented in The Art of Manipulation by Clyde Lentz and Bill Kenton (1955). Any locksmith or security personnel involved with non-destructive opening of combination locks or safes will be familiar with the process of manipulation to an extent to enable the individual to proficiently determine the combination of a lock.

Several mechanical methods have also been developed to open a combination lock. U.S. Pat. Nos. 2,974,517 to Jacobs, 4,056,956 to Gilliam and 4,433,563 to Wilson demonstrate various mechanical lock opening devices.

Jacobs teaches a motorized clamp which vibrates the members of a combination until they adjust themselves into an unlocked position. Gilliam teaches a torque wrench type device which imparts a torque to the handle of a safe in order to determine the location of a gate relative to the tailpiece of the lock as its dial is rotated. Wilson teaches a computer controlled motor which is driven through a series of combinations until the correct combination is stumbled upon.

SUMMARY OF THE INVENTION

The preferred embodiment of the present invention is a device which, through utilization of an optical scanner and a sensitive sound detection and discrimination system, enables an operator to more easily and readily utilize manipulation techniques to open a combination lock.

The present invention greatly assists the locksmith in performing manipulation and can enable an unskilled locksmith to proficiently perform manipulation without developing the extensive skills necessary to practice manipulation proficiently without the aid of the present invention.

The determination of the combination of a lock through the process of manipulation requires that the manipulator first determine the number of wheels of the lock, then determine the location of the gate on each of the wheels. Once the location of the gates is known, the fence of the drop lever is positioned to engage all of the gates at once while the nose of the drop lever is engaged in the drive cam opening in order to open the lock.

It is possible to determine the dial settings which correspond to the alignment between a gate on one of the wheels and the drop lever fence, without aligning the other wheels. First a determination is made as to the dial indication range wherein the drop lever nose is resting in the cam opening. All wheels are rotated until the fence of the lock is aligned with the gate of one of the wheels. When the fence is aligned with the gate in one of the wheels, the nose of the drop lever will seat more deeply into the cam opening. This will narrow the range over which the nose will strike opposite sides of the cam opening.

The operator therefore rotates the wheels to trial positions and then rotates the dial back within the indication range where the nose seats in the drive cam opening and determines if this seating range has narrowed. If the range has sharply or significantly narrowed, then the trial setting will probably indicate the location of the gate of one of the wheels.

The present invention aids the locksmith in this manipulation. The optical target is attached to the dial and aligned with the optical scanner such that the tip of the scanner is aligned with the approximate center of the target when the cam is rotated to one edge or the other of its nose seating range. This is used as a reference location. Any slight movement of the dial will therefore be precisely detected by the optical scanner and is displayed on the front panel of the decoder. The wheels are rotated to trial position and the cam is rotated back to within the seating range. The microphone will pick up the noises made by the drop lever, and the discrimination circuitry of the decoder will detect the seating of the drop lever in the cam opening and will freeze the display to indicate the exact location of the dial. This location is compared to the reference location and a determination is made as to the identity of gate locations.

It is an object of this invention to provide a device the implementation of which will render art of manipulation to be more proficiently practiced by both skilled and unskilled individuals.

It is another object of this invention to provide an apparatus which will enable an unskilled locksmith to perform manipulation without the expenditure of time and effort necessary to develop sophisticated manipulation skills.

It is a further object of this invention to replace the senses of touch hearing and sight of a manipulator and thereby enable him to more proficiently practice his craft.

It is still another object of this invention to substitute the electronic sensors of the present invention for the senses of a proficient manipulator whose senses may have begun to deteriorate over time.

It is still a further object of the present invention to provide a more easily practiced method of non-destructive intrusion of a safe.

It is a further object of this invention to assist an individual in the trade of locksmithing who desires to practice the art of manipulation but lacks the ability to develop his senses to the level necessary to become proficient in the art.

BRIEF DESCRIPTION OF THE DRAWINGS

For a further understanding of the nature and objects of the present invention, reference should be had to the following detailed description, taken in conjunction with the accompanying drawings in which like parts are give reference numerals and wherein.

DETAILED DESCRIPTION OF THE EXEMPLARY EMBODIMENTS

Figure 1:
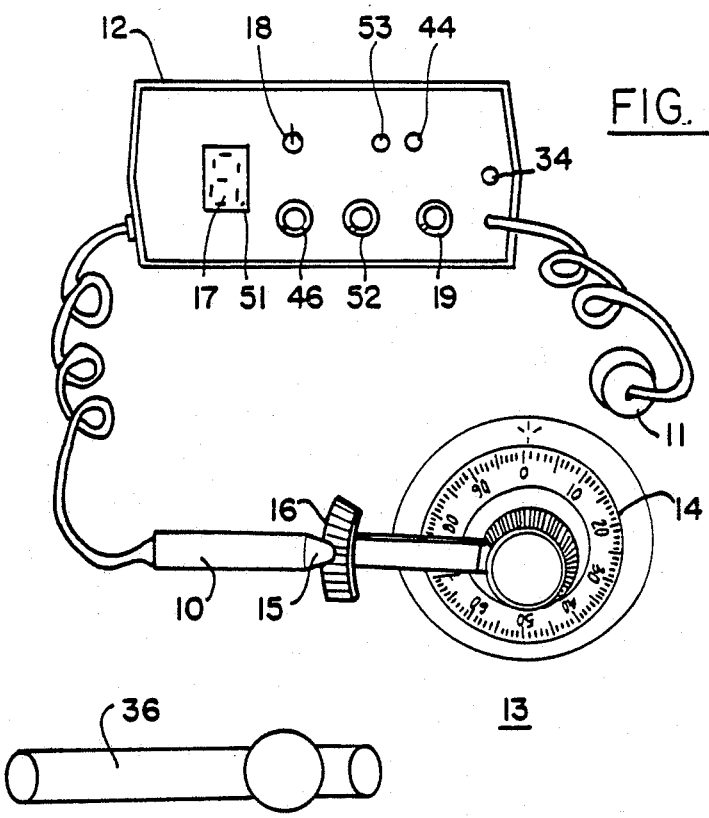
FIG. 1 is a front view of a safe door, showing the elements of the present invention in position to assist a locksmith in the process of manipulation.

FIG. 1 illustrates the preferred set-up of the present invention for assisting a locksmith in determining the combination of a safe lock through the technique of manipulation. An optical scanner 10 and microphone 11 are connected to the decoder 12. An exemplary scanner for use with the present invention would be the SSID Infrared Digital Scanner manufactured by Welch Allyn, Inc. Industrial Products Division of Jordan Road, Skaneateles Falls, N.Y. 13153 or its equivalent. The microphone 11 is positioned in contact with the safe door 13 in proximity to the dial 14 in a location where the sounds of the drop lever 20 (shown in FIGS. 4 and 5) will be detected. The scanner 10 is positioned so that the optical detection tip 15 is adjacent the target 16 when the nose 21 of the drop lever 20 is seated in the cam opening 22.

The decoder 12 can be placed at any location within reach and sight of the operator who must read indications from the display 17 and operate power switch 19 and freeze enable switch 18, while manipulating the dial 14.

Figure 4:
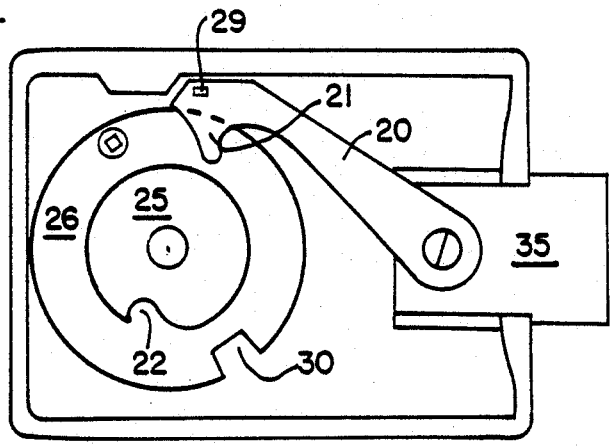
FIG. 4 is a rear view of the interior of a combination lock mechanism.
Figure 5:
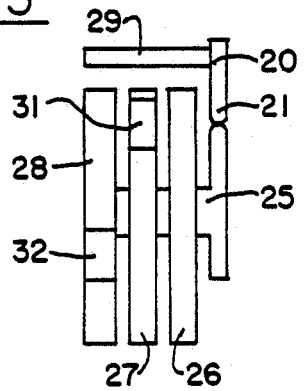
FIG. 5 is a side view of the lock mechanism of FIG. 4 showing the relative position of the wheels, cam and drop lever.
Figure 6:
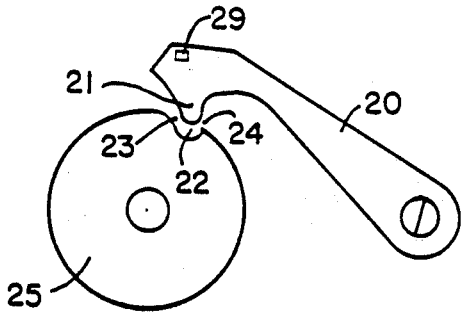
FIG. 6 is a partial view showing detail of the drop lever and cam engagement.

Prior to positioning of the scanner 10 and target 16 the operator must determine the location of the contact areas 23 and 24, of the cam opening 22 with relation to the drop lever nose 21 (illustrated in FIGS. 4 and 6). Determination of the dial 14 indication when the drop lever nose 21 is engaged with the cam opening 22 is the first step in manipulation. The dial indication when the cam 25 is rotated to the exact position of contact between the nose 21 and either cam opening contact area 23 or 24 is used as a reference reading. It is preferred that the reference reading is taken from the sloping side 23 as this point of contact will vary more as the nose 21 sets lower in the opening 22.

The initial reference reading is taken with the nose 21 in its most shallow engagement into the opening 22. This will give a reference for utilization in determining when the nose 21 has dropped further into the opening 22. The nose 21 will not drop fully into opening 22 unless all gates 30, 31 and 32 of all wheels 26, 27 and 28 are aligned, and positioned below the fence 29 so that fence 29 can drop into the gates. When none of the gates 30, 31 and 32 are aligned with the fence 29, the nose 21 of the drop lever 20 will ride on the surface of the cam 25, and the fence 29 will be spaced from wheels 26, 27 and 28. When nose 21 is aligned with cam opening 22, the fence 29 will rest on the outside of the wheels 26, 27 and 28. First, the dial 14 indication for the rotation point at which the nose 21 is aligned with the opening 22, as illustrated in FIG. 6, is established. The dial 14 is oscillated back and forth over a range of a few numbers while the operator listens for the sound of the nose 21 striking contact areas 23 and 24. In order to establish the dial indications where the nose 21 contacts contact areas 23 and 24 a series of ranges is tested until the contact sounds are heard. The difference in the two points of contact will be in the range of 8 to 10 numbers on a standard "100" number dial 14 or approximately 29 to 36 degrees of rotation. One of these two points of contact is chosen as a reference. Either point of contact can be chosen, however, the contact between sloping contact area 23 and nose 21 is preferably chosen because the sloping side 23 of the opening 22 will give the greatest deviation of position readings as the nose 21 drops lower into the opening 22.

As an example we will assume that the nose 21 strikes the contact area 23 when the dial indicates "0" as shown in FIGS. 1 and 6. Rotating the dial 14 clockwise from this position will cause the nose 21 to strike contact area 24 about indication "90" or approximately 36° from contact between nose 21 and contact point 23.

In order to determine the location of each gate on each wheel, the wheels are rotated by proper manipulation of the dial 14 through their full 360° of rotation stopping at each 2½ incremental indications of a standard "100" number dial 14 or in other words approximately every nine degrees. Other segments of indication can be used for stopping and taking trial readings depending on the particular lock or situation, however, 2½ dial indications is recognized as a standard incremental unit.

The dial 14 is set to the position where the indication is "0". The target 16 is then attached to the dial 14 and the optical sensor 10 is attached to the door of the safe 13 in alignment with the approximate center of the target 16. This will give an initial preferable reference reading of 5. When the dial 14 is rotated the span of one number (or approximately 3.6°) the entire length of the target 16 passes by the optical scanner head 15. This increases the accuracy of detection of slight variations in the position of dial 14, thereby increasing the accuracy of measurement of contact between nose and contact area 23. The passage of the target 16 by the scanner tip 15 is detected by the scanner 10 and assimilated by the decoder 12 circuitry. The position of the target 16 relative to scanner head 15 is indicated by the decoder on display 17.

With the scanner 10 and target appropriately set the manipulator can begin to manipulate the lock by rotating dial 14 so as to move all three wheels together to a series of trial locations. The wheels are positioned at a first location and then rotated clockwise and stopped at trial locations every 2½ numbers or approximately every 9° of rotation. While in the original position and at each stopping trial position, the dial 14 is turned counterclockwise, so as to rotate the cam without rotating the wheels, until the nose 21 again contacts the contact area 23. The wheels are rotated together stopping every 9° until the wheels have made a complete revolution.

The nose 21 should contact area 23 at a dial 14 indication of 0° if the fence 29 is still not aligned with any of the gates of any of the wheels. If the trial position for any wheel is an appropriate combination number or close to a combination number, the fence 29 will be aligned or partially aligned with the gate of that wheel. This alignment or partial alignment will cause fence 29 to at least partially seat in the gate. Therefore, when the cam 25 is rotated back to the reference contact position, the nose 21 will seat more deeply into opening 22 and the indication of the contact between surface 23 and nose 21 will be slightly displaced.

Normally under manual unassisted manipulation, the operator would visually note the dial 14 reading when the strike point was reached. However, with the scanner 10 and target 16 properly positioned, the target 16 will be sweeping in front of the scanner head 15 as the contact is made. The sound of the contact will be detected by the microphone 11 which through the circuitry of FIG. 7 will freeze the display 17 to give an extremely precise reading.

Figure 7A:
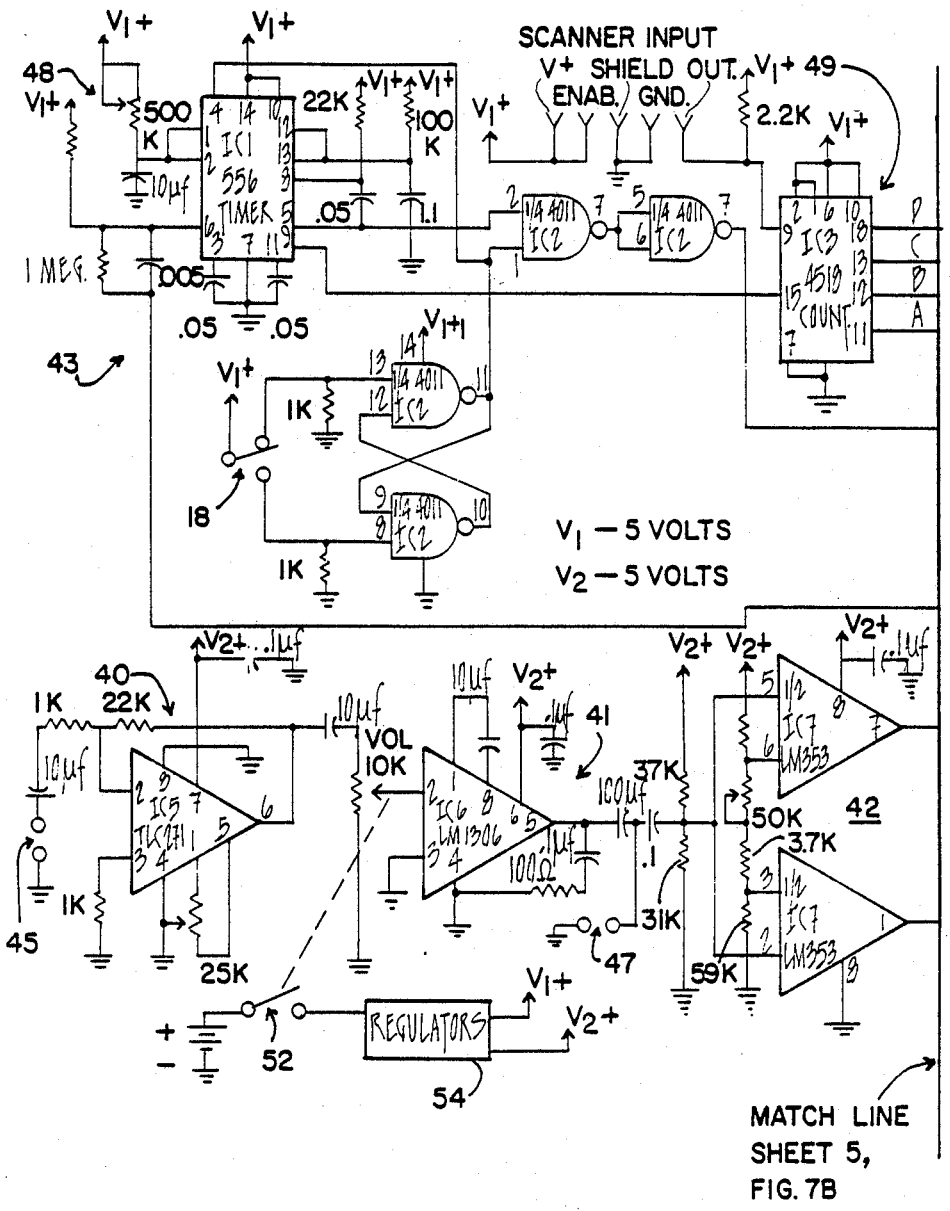
FIGS. 7A and 7B is a schematic diagram of the decoder box circuitry.
Figure 7B:
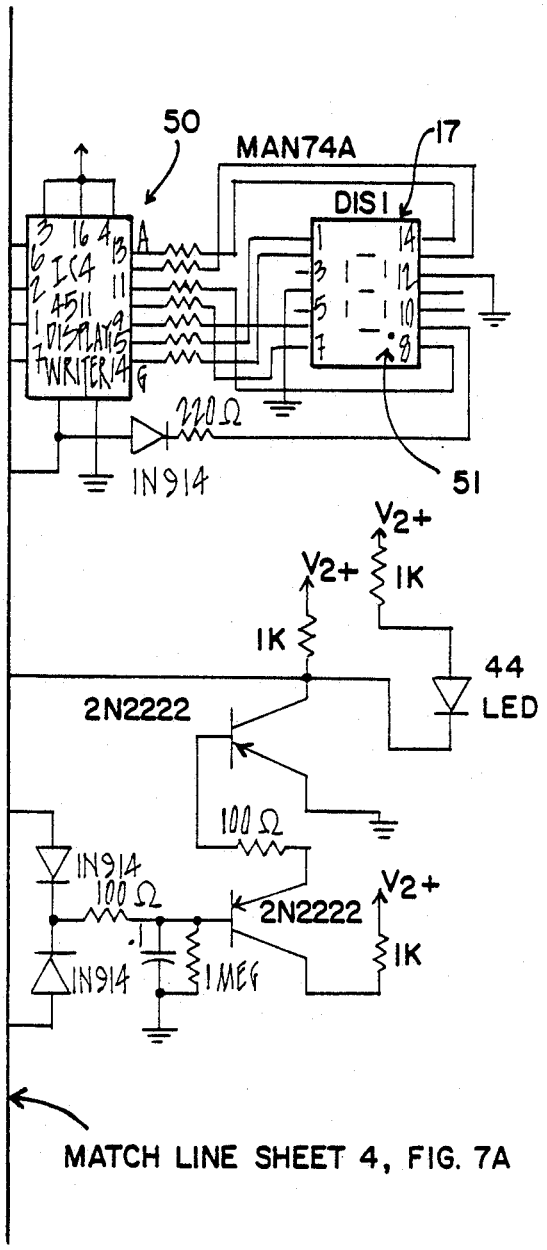

FIG. 7 illustrates the circuitry employed in the decoder 12 of the present invention. The leads from the microphone 11 are connected to the preamp 40 at 45. The output of preamp 40 is fed to the power amp 41 with headphone output 47. A headphone can be attached to the decoder 12 at socket 34 to enable the operator to monitor the sounds detected by the microphone 11. The peak detector 42 circuitry monitors the output of the power amp 41 to drive the peak indication LED 44, and to trigger display freeze timer 43.

When enabled by freeze enable switch 18, triggering of timer circuit 43 will cause the present count of counter 49 to be frozen on display 17. The length of time that the display will remain frozen is variable by turning knob 46 which will vary the setting of adjustable potentiometer 48.

The number shown on display 17 is generated by the scanner output which increments counter 49 which through binary coded decimal-to-digital converter 50 drives display 17. The decimal point 51 of display 17 is connected so as to light during the time interval that display 17 is frozen.

Power to the decoder is controlled by power switch 52 which also adjusts the volume of amp 41. Switch 52 controls the battery supply to the pair of regulators 54 which supply independent voltages $V_1$, for the scanner count and timer circuitry and $V_2$ for the noise detection circuitry.

All of the noise detected by the microphone 11 is fed through the preamp 40 and amp 41 into the peak detector 42. When a noise spike or peak is detected by the microphone 11 it is usually indicative of contact between the nose 21 and a contact area 23 or 24.

When the display 17 freezes, the operator knows that contact has been made. The operator records the contact display 17 indications for each of the trial positions for a full rotation of the wheels. Most of the display 17 indications should show very slight if any change from the original reference position of the cam 25. However, the display 17 will be frozen to indicate contact at a position significantly different from the reference position for at least one trial dial 14 setting indicating alignment of a gate in a wheel and the fence 29.

When all positions at 9° increments of the wheels have been tried, those trial locations which indicate significant change in nose 21 to cam area 23 contact from the reference location are rechecked at each possible combination number in that area to determine the exact location where the greatest strike point deviation occurs. This will indicate proper alignment between fence 29 and a gate.

Below is an illustrative example of the steps in determining the location of the first gate. A dial with "100" indication increments is assumed.

Turn dial 14 four times clockwise carrying all wheels to "0". Turn dial 14 counterclockwise to contact point. Note reading on display and record.

Turn dial clockwise moving all wheels to "97½".

Turn dial counterclockwise to contact point. Note reading on display and record.

Turn dial clockwise moving all wheels to "95".

Turn dial counterclockwise to contact point. Note reading on display and record.

Turn dial clockwise moving all wheels to "92½".

Turn dial counterclockwise to contact point. Note reading on display and record.

Follow above procedure every 2½ numbers moving all wheels completely around the dial taking readings and making recordings.

The recorded readings will, for example, look like those below assuming an initial reference contact point of "0", and

TABLE 1

| wheel positioned at | manual | decoder display optical scanner |
|---|---|---|
| 97½ | 0 | 5 |
| 95 | 0 | 5.5 |
| 92½ | 99⅞ | 4.0 |
| 90 | 99⅞ | 4.5 |
| 87½ | 99¾ | 3.0 |
| 85 | 99¾ | 3.5 |
| 82½ | 99⅞ | 4.5 |
| 80 | 99⅜ | 2.5 |
| 77½ | 99¼ | 1.0 |
| 75 | 99⅜ | 2.5 |
| 72½ | 0 | 5.0 |
| 70 | 0 | 5.5 |

In the above example of readings from the decoder display 17, the optical scanner 10 and target 16 were initially aligned to give a reference reading of 5.

An important advantage of the present invention is in providing the operator with a much more accurate reading of the dial position when contact is made. An operator may have difficulty in determining slight changes in strike position which may be as little as ¼ to ⅛ of an indication from the reference point. Therefore, a manipulator can easily miss a significant change and may therefore miss a possible combination setting number.

It can take a long time to develop the skill necessary to enable a manipulator to detect a slight change from a strike indication of "99" to "99¼" while simultaneously spinning the dial and listening for contact noise. However, the present invention does not require the development of fine skills. The display is automatically frozen when contact noise is detected. The readings are very accurate because the span between two indication marks is expanded to 10 optical divisions therefore the scanner measures in tenths of an increment accurately not in a visual estimate of eighths of an incremental change.

Once a probable alignment location has been established, such as "77½" in the example above, more accurate readings are taken at each of the dial numbers around that location e.g. from "72" to "82" in increments of "1". This is where an even more precise reading of contact location can be more critical to proper combination number identification, and therefore the present invention becomes more valuable. The trial combination location should be narrowed to a single number at this point, for illustration purposes, assume "76" gives the lowest point of contact reading in an example.

At this point in the manipulation a determination has to be made to discover which of the three wheels 26, 27 or 28 is producing the indication "76" found above. The manipulator turns the dial 14 clockwise at least four times and stops at "76" to set all wheels at this location. The manipulator rotates the dial 14 counterclockwise a full revolution moving only the drive cam 25 and then continues 10 more increments to "86" displacing the wheel closest to the drive cam.

With the wheels thusly positioned, the manipulator rotates the dial 14 clockwise to the point of contact and observes the reading on the display 17. Wheels 27 and 28 are set on "76" and wheel 26 is set on "86", therefore, if the low indication, i.e. "1.0", is lost and the display is frozen at about "5", then the gate 30 of wheel 26 was most likely aligned at "76" producing the contact displacement indication.

If a low reading, e.g. "1.0", was still obtained then the dial 14 is rotated twice counter-clockwise to "86" this time displacing wheel 27 from "76" to "86". The dial is rotated clockwise to take a contact reading which is evaluated as above. If the reading now returns to reference, e.g. "5", then gate 31 of wheel 27 was producing the contact shift at "76" if the reading is still low, e.g. "1.0", then the only wheel remaining at "76", i.e. wheel 28, must have its gate 32 aligned with the fence 29.

Assuming the reading of "76" was determined to be produced by wheel 26, the alignment for the next wheel must now be determined. To determine the location of the alignment of the next gate and fence 29, wheels 27 and 28 are positioned at a trial indication location and wheel 26 is positioned at what was its determined alignment location (e.g. "76") and then cam 25 is rotated until contact is made and this contact display indication point is recorded for comparison as the new reference location.

Assuming a dial 14 with "100" indication marks as shown in FIG. 1, and assuming that wheel 26 indicated alignment at a dial indication of "76", the following is an illustrative example of the determination of the alignment for wheel 27.

Turn dial 14 clockwise four times, stopping at "97½".

Turn counterclockwise one complete revolution of the dial 14 and at "97½ "you pick up wheel 26 and continue counterclockwise stopping at "76".

Turn dial 14 clockwise to contact point, and record display 17 indication.

Turn dial clockwise, picking up wheel 26 at "76", continue clockwise picking up wheels 27 and 28 at "97½" and stopping at "95".

Turn dial counterclockwise one complete revolution, picking up wheel 26 at "95", continue counterclockwise stopping at "76".

Turn dial clockwise to contact point, and record display 17 indication. Continue with the above procedure every "2½" numbers, clear around the dial 14, each time placing wheel 26 on "76" and recording the indications frozen on display 17 when contact is made.

The display readings are interpreted as above looking for a sharply lower value and for the lowest value. At the trial location yielding the lowest display value or sharpest drop in display value is a possible second combination number. This possible combination number is thus narrowed by the techniques above where each indication number is tested to determine the lowest value. A determination is made, as detailed above, to discover which wheel has produced this second indication. Wheels 27 and 28 are independently thrown off from the new possible combination number until a low indication is no longer obtained on display 17 while wheel 26 is still transferred to "76".

These two numbers are then dialed into the combination lock in the usual manner of opening a lock and the third number is discovered by simple trial. The dial 14 is then rotated to withdraw bolt 35, and actuating handle 36 is then operated to move the door bolts out of engagement and the safe door is opened without force or destructive intrusion.

The technique outlined above is well known in the locksmith and security industry art and can be utilized by a skilled, practiced locksmith without the aid of the present invention. The present invention, however, enables an individual without developed skill but with proper training to practice manipulation and it enables a skilled individual to manipulate more easily and quickly. The operator's senses of hearing, sight and feeling can be more sensitively and accurately replaced by the elements of this invention. The unique manner of configuring and achieving interdependent cooperation of these elements to greatly assist the practice of manipulation satisfies the need for a readily implementable method for the practice of manipulation.

The above outlined technique is practiced as described above and by attention to the details of operation below described. Practice of the invention as outlined below will enable easier more precise utilization of the advantages of the invention.

You must know the process of manipulation above in order to utilize the present invention.

The present invention was not intended to replace the process of manipulation, but only to aid the experienced in deriving a combination.

The manipulator must first locate the left and right side of the contact in the manner described above and determine whether to use one, or both contact areas.

Figure 2:
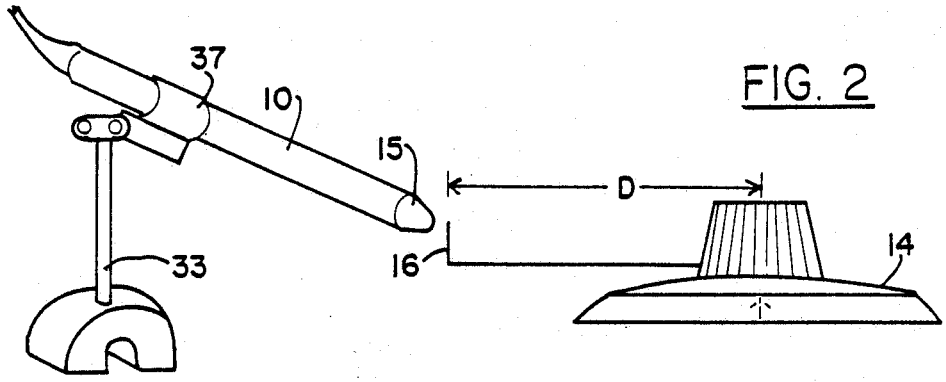
FIG. 2 is a side view of the scanner and target in operative position.

If only one side of the contacts is to be used, reference is had to Table (2) for target to dial center (D in FIG. 2) information. Four exemplary targets of read ranges 0.114 to 0.200 inches are illustrated to enable the present invention to read from 1 number to ¼ number full scale. The dimensions of an exemplary target with a read range A of 0.114 is illustrated in FIG. 3, the black and white bands would be proportionally wider for read ranges of 0.142–0.200.

With this type of optical scanner and target, the field of view can be adjusted. In other words the further the target is moved away from the dial center, the more sensitive the response will be, because rotation of the dial through fewer degrees will pass the entire target 16 below the scanner tip 15.

Figure 3:
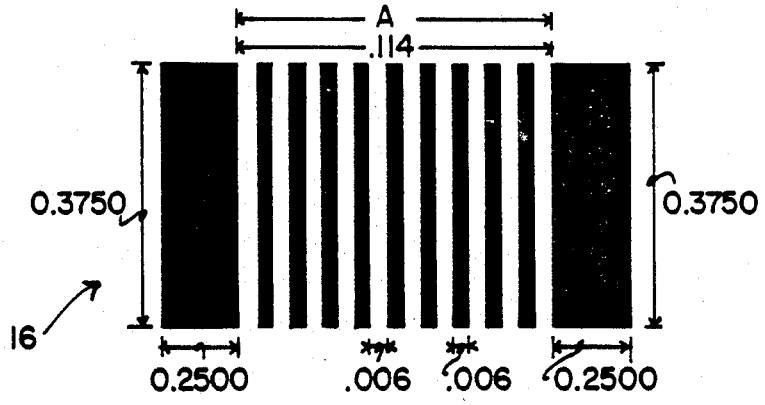
FIG. 3 is a front view of an exemplary target.

For example, in Table (2) using the read range of the target illustrated in FIG. 3, which is 0.114 inches, when placed at 1 13/16 inches from dial center, the scanner will divide the distance between 2 numbers into 10 increments of 0.006 each. In other words, 1 number movement on the dial 14 reads full scale ten numbers on the display 17.

The read range can be increased by going to a further distance. For example, if the target were set to 2¾ inches from dial center, with the read range of the target changed to 0.172 inches the distance of travel of the dial is divided in half. This means the scanner will read 10 increments within half the distance between two numbers on the dial.

This method works well when the tumblers show only a slight change in their configuration and therefore a more sensitive reading is necessary.

TABLE 2

| Target distance to dial center "D" | Read range of target in inches | To read "X" numbers full scale |
|---|---|---|
| 1 13/16 | .114 | 1 |
| 2 17/64 | .142 | .75 |
| 2¾ | .172 | .50 |
| 3 3/16 | .200 | .25 |

After selecting the target and distance, the dial 14 is placed at the contact area to be read from. The target 16 is attached to the dial 14, in a location leaving sufficient room for the scanner 10 to mount to the safe door 13.

The sound detector 11 is attached to the safe door 13 near the dial 14, ensuring the target 16 will not hit the sound detector 11 when spinning the dial 14 around.

The decoder 12 is turned on and the volume 19 adjusted, while oscillating the dial 14 in the contact area. The peak detector LED 44 should flicker. If LED 44 is not flickering, peak detector 52 adjustment may be adjusted if necessary to respond to contact noise, (the drive cam 25 striking the nose 21 of the drop lever 20). Increasing the volume 19 also increases the sensitivity of the peak detector 42.

The scanner holder 33 is attached to the safe door and the scanner 10 into the clip 37 on the holder 33. The dial 14 is placed at the contact area to take readings from, then the scanner tip 15 is aligned over the center of the target 16 at a distance not to exceed 0.075 inches and at an angle of not more than 30 degrees.

With the sound detector 11 set and the freeze mode switch 18 in the "OFF" position, proper alignment is checked. The target 16 is placed under the scanner tip 15 and the outside black area of the target 16 is aligned just under the tip 15 of the scanner 10.

Now the target 16 is passed under the scanner tip 15 and the display reading 17 is noted. If proper alignment is made, then the scanner 10 would count all ten increments each time the target 16 is fully scanned. In other words to fully scan the target 16, place the target 16 to the extreme edge and pass fully under the scanner to count all increments. If the display reading does not return to the same number that was displayed before scanning the target, the detector and target are improperly set. If you are using the double contact reader align one side 53 as described above, and rotate the dial 14 to the other contact area. While maintaining the dial at that location, the adjustable target 53' is moved toward the tip 15 of the scanner 10, and centered under the tip 15. Alignment of both targets is rechecked as described above.

The freeze mode switch 18 is turned "ON" and the tumblers are ganged to put them in position to take the first reading. This will be the reference reading. After putting the tumblers in place, and turning back to the contact area as if you were going to take a manual reading, stop the target 16 at the scanner 10 before making contact with tip 15 aligned , within the outside black area of target 16. If reading the "right" contact the tip 15 should be positioned on the "left" side of the target 16 scanning counterclockwise, if reading the "left" contact, tip 15 is positioned on the "right" side of the target 16 scanning clockwise. The target 16 is passed under the scanner gently but swiftly to be sure the peak detector is responding to the drive cam 25 striking the nose 21 of the drop lever 20.

The sound detector 11 stops or freezes the counter 49 from counting the output of the scanner 10 for a predetermined amount of time. The time delay 46 may be adjusted clockwise to increase or counterclockwise to decrease. After the pause time has elapsed the display will reset to "0". Before taking a new contact reading, the display is reset to "0".

After taking a contact reading, the reading on the display is noted. If it is higher than 6, or under 5, the scanner 10 must be aligned in such a way as to give a reading of about a 5 or 6 on the display 17. In this way, the scanner 10 will have room to read up and down to show the configuration of the tumblers.

Figure 8:
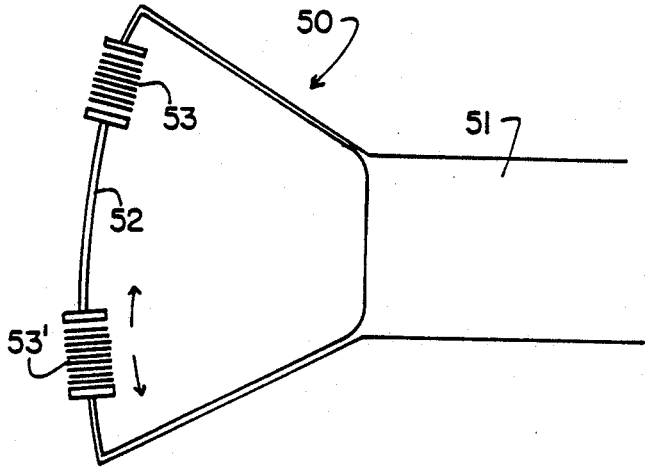
FIG. 8 is a top view of the double target holder.

If utilizing double contact readers, the operator must also adjust the target slide to give a reading of about a 5 or 6 from the second target 53'. The double contact reader 50 illustrated in FIG. 8, utilizes a first target 53 and a second target 53'. Manipulation utilizing the double contact reader 50 instead of a single target 16 is practiced in essentially the same manner, except that two sets of contact readings are taken instead of one.

The double contact reader 50 is attached to dial 14 by arm 51 in the same manner as target 16 is attached to the dial 14. The first target 53 is attached stationary relative to arm 51 and is positioned and adjusted in the same manner as target 16 described above. Target 53', however, is adjustable along connector 52 so that it can be moved closer to or further from target 53.

Target 53 is set up so as to be centered under scanner tip 15 at one contact point. The dial is rotated to the other contact point about 7 to 10 numbers away and then target 53' is centered under tip 15 by movement of target 53' along connecting bar 52. In this manner targets 53 and 53' are positioned at opposite ends of the engagement zone of nose 21 in cam opening 22.

The double contact reader is utilized when it is desirable to take readings from both contact points in order to practice manipulation.

After recording the contact readings, they are evaluated the same way as if taken manually.

For example: If the display 17 readings are 5 or 6 over a span of distance around the dial 14, then at one location the readings drop down to a 2 on the display 17, then rise back up to a 4 or a 5, that setting of the dial 14 would be interpreted as a low spot or gating from one of the wheels.

When determining which of the tumblers is giving the indication the procedure is as outlined above. Instead of noting the lowest reading when each tumbler is moved off of the gate location, the highest contact reading is significant.

The present invention will work on most safes where manipulation will lead to the determination of the numbers of the lock combination.

For example: you can affix the target holder to the handle of a straight tail piece lock, and align the scanner there. Then place the sound detector near the dial for sound detection, checking the handle for slight increases in free travel distance.

Because many varying and different embodiments may be made within the scope of the inventive concept herein taught, and because many modifications may be made in the embodiments(s) herein detailed in accordance with the descriptive requirements of the law, it is to be understood that the details herein are to be interpreted as illustrative and not in a limiting sense.

What is claimed is:

1. A locksmith tool for assisting a locksmith in the manipulation of a combination lock comprising;

decoder means, sound detection means positioned proximate to said lock to detect sounds internal to said lock and connected to said decoder means for supplying first signals to said decoder means corresponding to said detected sounds, position detecting means connected to said decoder means and to the dial of said combination lock, for supplying second signals to said decoder means corresponding to the position of said dial, and display means connected to said decoder for display of dial position information, wherein said decoder means includes means for correlating said first signals with said second signals.

2. The tool of claim 1, wherein said decoder means is further comprised of;

discrimination means for identifying significant sounds detected by said sound detection means.

3. The tool of claim 2, wherein said decoder means is further comprised of;

inhibiting means for maintaining the display of dial position information corresponding to the detection of a significant sound.

4. The tool of claim 1, wherein said dial position indicator is comprised of an optical scanner and optical target.

5. A tool for use in determining the locations of gates in the combination lock of a safe of the type having a door with a combination lock, a combination dial for operating the lock, a cam and wheels driven by the dial and having a drop lever coupled thereto, the tool comprising the combination of;

decoder means, sound detection means, positioned proximate to said lock for detecting sounds generated by contact of said drop lever and said cam of said lock, and connected to said decoder means for supplying first signals to said decoder means corresponding to said detected sounds, position detection means connected to said decoder means and to said dial for detecting the position of the dial of said lock, and for supplying second signals to said decoder means corresponding to the position of said dial, and display means connected to said decoder for display of dial position information, wherein said decoder means includes means for coordinating said first signals with said second signals.

6. The tool of claim 5, wherein said sound detection means further includes means for supplying a first signal to said decoder means corresponding to detected sound.

7. The tool of claim 6, wherein said dial position detection means further includes means for supplying a second signal to said decoder means corresponding to the detected dial position.

8. The tool of claim 7, wherein said decoder means further includes;

means for utilization of said first and said second signal to display a detected dial location corresponding to the detection of sound produced by contact of said drop lever and said cam.

9. Apparatus for assisting in the determination of the opening combination of a lock having a dial, a plurality of tumblers that are placed in alignment when an opening combination is set into the lock, a driver operatively connected to the tumblers that is able to move through a lock opening sequence when the tumblers are aligned to withdraw the lock bolt, the apparatus including;

decoder means, sound detection means connected to said decoder means configured for detection of tumbler noise and for supplying signals indicative of said detected noise to said decoder means, dial position detecting means connected to said decoder means and to said dial for supplying dial position information to said decoder, display means connected to said decoder means for display of said dial position information, wherein said decoder means includes means for correlating said first signal and said second signal.

10. The apparatus of claim 9, wherein said decoder means is further comprised of;

discrimination means for identifying significant sounds detected by said sound detection means.

11. The apparatus of claim 10, wherein said decoder means is further comprised of;

inhibiting means for maintaining the display of a dial position detected simultaneously with the detection of a significant sound.

12. The apparatus of claim 10, wherein said dial position detector is comprised of an optical scanner and optical target.

13. The apparatus of claim 12, wherein said dial position detector includes a second target.

14. A manipulation tool for locks which have a rotatable cam element comprising:

(a) a decoder with signal processing capability, (b) sound detecting means for detecting sounds generated by rotating the cam element and generating a first signal indicative of detected sound, said sound detecting means being in signal communication with said decoder, (c) position detecting means for detecting the position of the cam element upon rotation and generating a second signal indicative of the position detected by said position detection means, said position detecting means being in signal communication with said decoder, and (d) display means for displaying indicia representative of said second signal where said first and second signals are processed and correlated by said decoder.

15. A tool according to claim 14 where the rotatable cam element comprises part of a dial type combination lock and to which said position detecting means is connected to the dial of the combination lock.

16. A tool according to claim 15 wherein said decoder means includes discrimination means for identifying significant sounds detected by said sound detection means.

17. A tool according to claim 16 wherein said decoder means includes inhibiting means for maintaining the display of dial position information corresponding to the detection of a significant sound.

18. A tool according to claim 17 where said position detection means is an optical scanner and an optical target.

19. A tool according to claim 14 further including means for utilization of said first and said second signals to display the detected position of the cam element corresponding to detection of sound generated by contact between said cam element and a lever element associated with said cam element.

20. A locksmith tool for assisting a locksmith in the manipulation of a combination lock comprising:

decoder means, sound detection means for positioning proximate to a combination lock to detect sounds internal to the lock, said decoder means being connected to said decoder means for supplying first signals to said decoder means corresponding to said decoder means corresponding to said detected sounds, position detecting means connected to said decoder means and for connection to the dial of the combination lock, for supplying second signals to said decoder means corresponding to the position of the dial, and display means connected to said decoder for display of dial position information, wherein said decoder means includes means for correlating said first signals with said second signals.

21. Apparatus for assisting in the determination of the opening combination of a lock having a dial, a plurality of tumblers that are placed in alignment when an opening combination is set into the lock, a driver operatively connected to the tumblers that is able to move through a lock opening sequence when the tumblers are aligned to withdraw the lock bolt, the apparatus, comprising:

decoder means, sound detection means connected to said decoder configured for detection of tumbler noise and for supplying signals indicative of detected noise to said decoder means, dial position detecting means connected to said decoder and connectable to the lock dial for supply dial position information to said decoder, display means connected to said decoder for display of said dial position information, wherein said decoder means includes means for correlating said first signal and said second signal.

* * * * *